US006102738A

United States Patent [19]

Macek et al.

[11] Patent Number: 6,102,738

[45] **Date of Patent: *Aug. 15, 2000**

[54] HARDLINE CATV POWER CONNECTOR

[75] Inventors: Thomas G. Macek, Endicott; David J. Stabile, Horseheads, both of N.Y.

[73] Assignee: Thomas & Betts International, Inc., Sparks, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,411

[22] Filed: Aug. 5, 1997

[51] Int. Cl.[7] ..... H01R 9/05

[52] U.S. Cl. ..... 439/584

[58] Field of Search ..... 439/584, 583, 439/578, 585

[56] References Cited

U.S. PATENT DOCUMENTS

| | | | |
|---|---|---|---|
| 3,764,959 | 10/1973 | Toma et al. | 439/584 |
| 4,346,958 | 8/1982 | Blanchard | 439/584 |
| 5,651,698 | 7/1997 | Locati et al. | 439/584 |

*Primary Examiner*—Gary F. Paumen
*Assistant Examiner*—Tho D. Ta
*Attorney, Agent, or Firm*—Weingarten, Schurgin, Gagnebin & Hayes LLP

[57] ABSTRACT

A power connector for a Cable Television (CATV) housing accepts two conductors at a first end. A first conductor, typically a power conductor is secured to a pin terminal of the connector. A second conductor, typically a ground conductor, is secured to the body of the connector. The connector is useful for easily and conveniently providing power to a CATV housing.

28 Claims, 8 Drawing Sheets

HARDLINE CATV POWER CONNECTOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Cable Television (CATV) housings receive power from a separate power cable which must be hard-wired to the internal electronics of a CATV housing. Such a setup requires disassembly of the housing in order to electrically and mechanically secure the power conductors within the housing. The CATV housing may be located outdoors such as at the top of a telephone pole or underground, making access to and disassembly of the housing more difficult. Such a process is time consuming, cumbersome and can result in installer induced problems. It would be desirable to have a power cable fitted with a connector for reliable mechanical and electrical connection to the power cable, as well as being simple to install and use.

BRIEF SUMMARY OF THE INVENTION

A power connector is disclosed which includes a body having a terminal which extends from within the power connector body to beyond an end thereof. The terminal is configured to receive a power conductor within a first end and includes a seizure mechanism for securing the conductor within the first end of the terminal. An insulator insulates the terminal from the connector body. A ferrule is configured to secure the outer conductor, typically a ground conductor, to the body of the connector. The connector may further include a plurality of o-rings to provide for sealing integrity and prevent RF performance degradation. As the connector pieces are mated together a secure connection between the connector and the power cable is produced. The connector is used to conveniently provide power to a CATV housing from a coaxial power cable.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
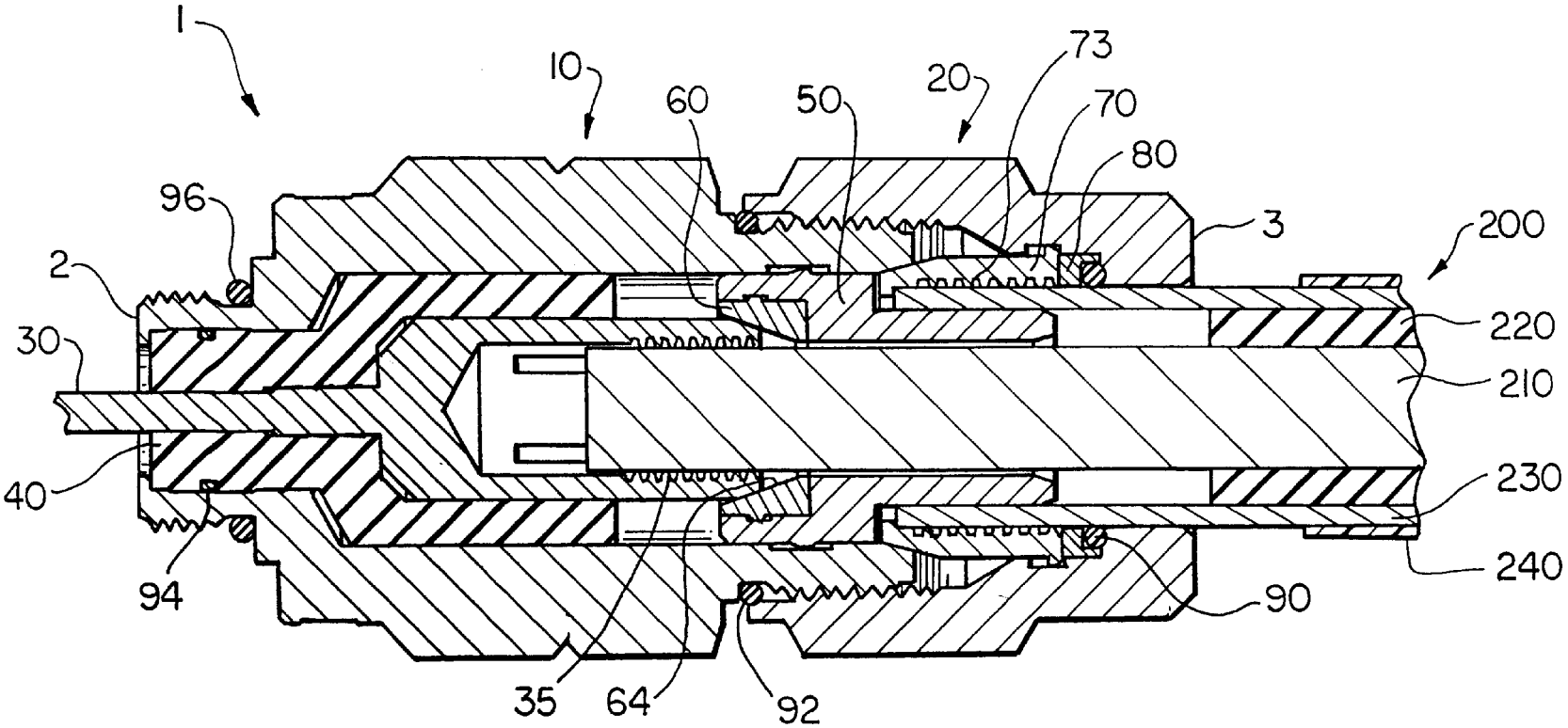
FIG. 1 is a cross-sectional side view of a two piece CATV power connector of the present invention.

FIG. 1 shows a two piece power connector 1 according to the present invention. The power connector 1 comprises an entry body assembly 10 mated with a clamp nut assembly 20. The connector 1 is configured to accept a power cable 200 at a first end 3, and to mate with a CATV housing (not shown) at a second end 2.

Figure 2:
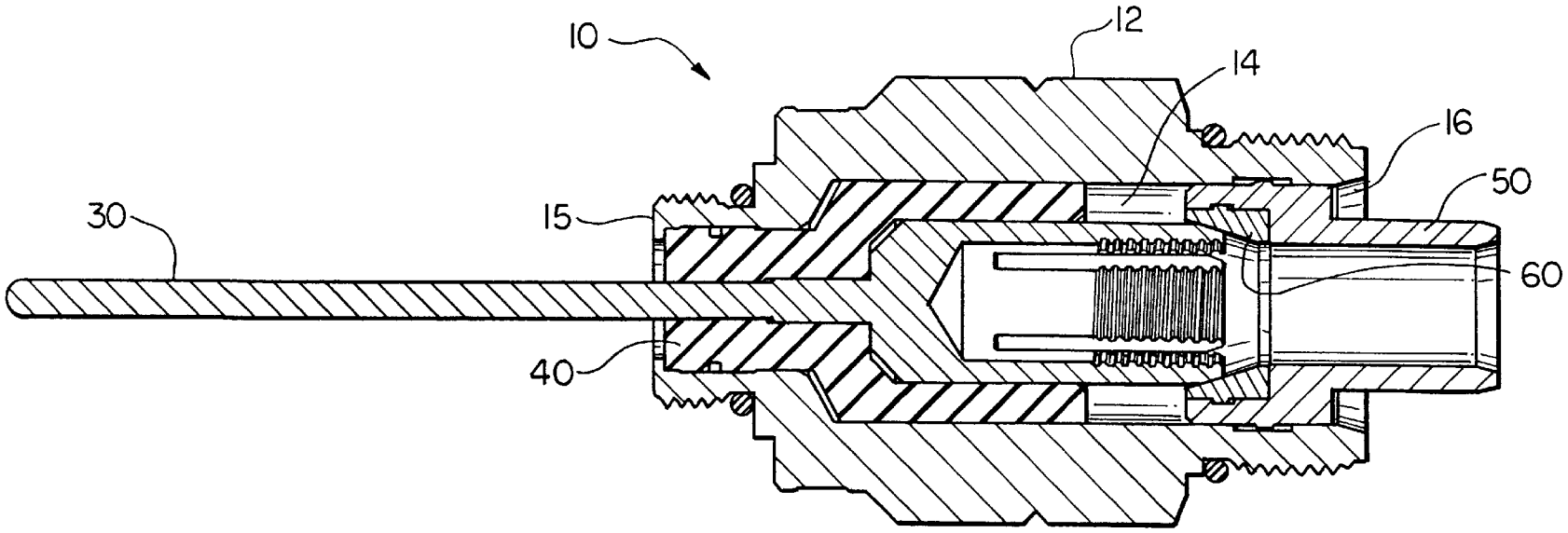
FIG. 2 is a cross-sectional side view of an entry body assembly.

The entry body assembly 10, shown in FIG. 2, comprises an entry body housing 12 open on a first end 15 and a second end 16 and having a bore 14 centrally disposed through the housing 12. A pin terminal 30, an entry support 40, a mandrel 50 and an insert 60 are disposed along a common longitudinal axis within the central bore 14 of entry body housing 12. The entry support is positioned such that one end is adjacent the first end 15 of the entry body housing 12. The pin terminal 30 is positioned within the bore of the entry support 40 and has a section extending beyond the first end 15 of the entry body housing 12. Insert 60 has an exterior flange which is configured to fit inside an annular slot of mandrel 50, thereby maintaining insert 60 within a section of mandrel 50. Mandrel 50 also includes an annular flange which is configured to fit inside an annular slot in entry body housing 12, thereby maintaining mandrel 50 within entry body housing 12. Pin terminal 30 is positioned within entry body housing 12 such that an end of pin terminal 30 is abutting the insert 60.

Figure 3A:
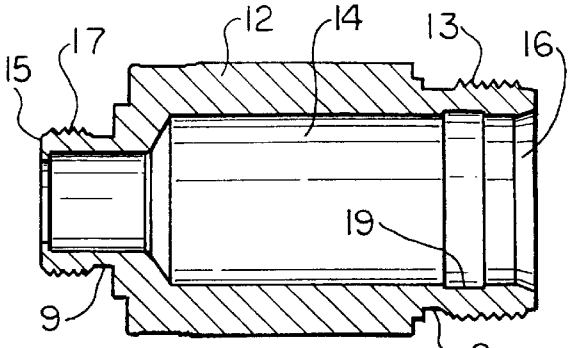
FIG. 3A is a cross-sectional side view of the entry body of FIG. 3.
Figure 3B:
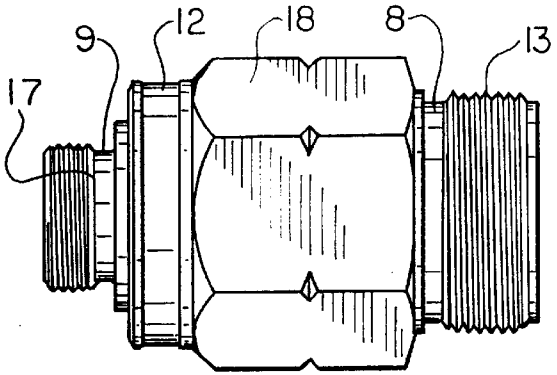
FIG. 3B is a side view of the entry body of FIG. 3.
Figure 3:
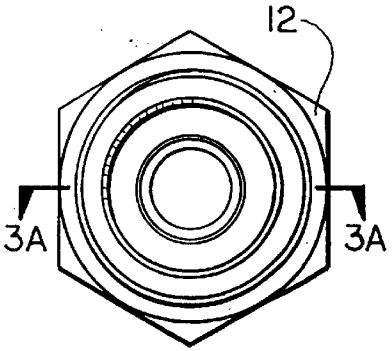
FIG. 3 is an end view of an entry body.

Referring now to FIGS. 3–3B the entry body 12 is shown. Entry body 12 is comprised of aluminum or other corrosion resistant material. A first end of the body 15 includes a threaded section 17 which is configured to mate with a cooperating CATV housing (not shown). A center section 18 of entry body 12 is hexagonally shaped in order to provide a surface that allows for sufficient tightening of first end 15 to the CATV housing. A second end 16 of entry body 12 includes a threaded section 13 which is configured to mate with another piece of the connector. An interior surface of entry body 12 includes an annular slot 19 for maintaining a mandrel flange therein when the mandrel is inserted into the entry body 12. Entry body 12 further includes a first exterior annular recess 8 and a second exterior annular recess 9, each configured to receive an o-ring therein.

Figure 4A:
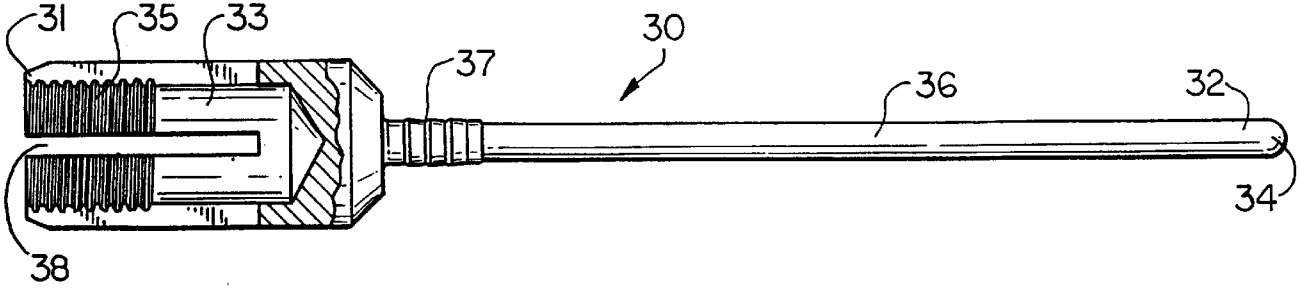
FIG. 4A is a cross-sectional side view of the pin terminal of FIG. 4.
Figure 4:
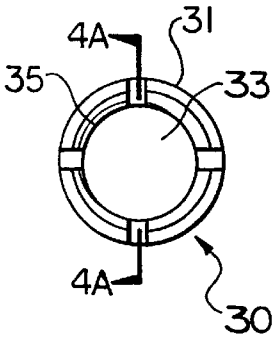
FIG. 4 is an end view of a pin terminal.

FIGS. 4 and 4A show pin terminal 30. Pin terminal 30 is comprised of brass, tin-plated brass or other conductive material. The terminal has a first end 31 which includes a bore 33 extending a predetermined distance into the first end 31. The bore 33 is configured to receive a power conductor (not shown) therein. The power conductor typically comprises copper or aluminum, and is sized from AWG #14 through AWG #2. A plurality of serrations 35 are disposed within the first end of bore 33 for securing the power conductor therein. The first end of terminal 30 also contains a plurality of longitudinal slots 38 which allow the first end to be compressed during assembly of the connector. Terminal 30 includes a long cylindrical section 36 extending to a second end 32. The cylindrical section 36 is provided with a series of ridges 37 for sealing with the entry support when the connector is assembled. The second end 32 of terminal 30 includes a tip 34 which is rounded, though other embodiments could incorporate differently shaped tips. Terminal 30 is sized to carry an electrical current of up to thirty amperes, and a voltage of up to ninety volts.

Figure 5A:
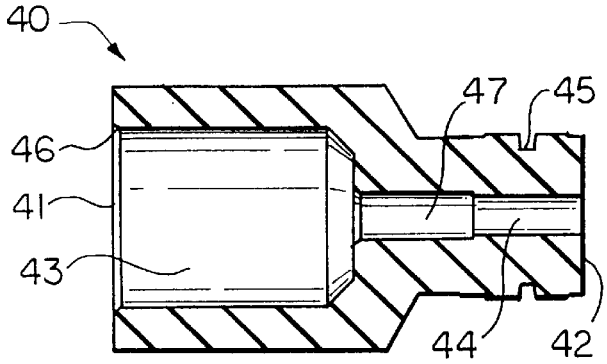
FIG. 5A is a cross-sectional side view of the entry support of FIG. 5.
Figure 5:
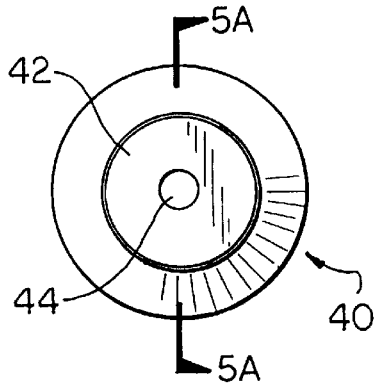
FIG. 5 is an end view of an entry support.

FIGS. 5 and 5A show entry support 40. Entry support 40 is comprised of nylon or other insulative material and is configured to support and insulate a section of pin terminal 30 within the entry body housing. Entry support 40 has a first bore 43 disposed a predetermined distance within a first end 41. First bore 43 is configured to receive a section of pin terminal 30 therein. A second end 42 of entry support 40 includes a second bore 44 which extends into first bore 41. Second bore 44 is sized to receive a portion of cylindrical section 36 of the pin terminal 30 therein. Entry support 40 also includes an annular recess 45 which is configured to receive an o-ring (not shown) therein. The end 46 of first bore 43 may be tapered to allow easier insertion of pin terminal 30 within bore 43. A middle section 47 is configured to provide a sealing fit with the ridges of the pin terminal.

Figure 6A:
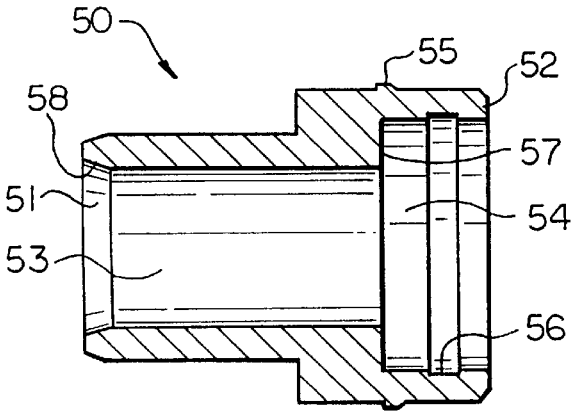
FIG. 6A is a cross-sectional side view of the mandrel of FIG. 6.
Figure 6:
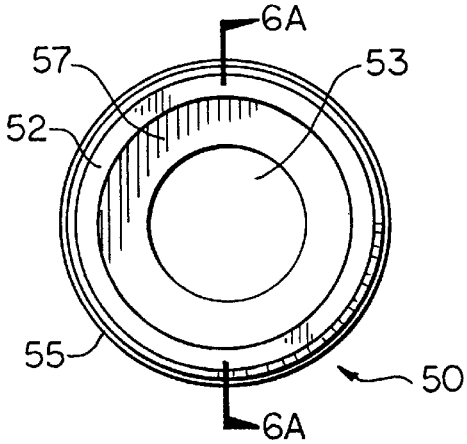
FIG. 6 is an end view of a mandrel.

FIGS. 6 and 6A show mandrel 50. In this embodiment mandrel 50 is comprised of non-conductive material such as nylon, though other non-conductive materials could also be used. Mandrel 50 is open on a each of a first end 51 and a second end 52. A first bore 53 extends a predetermined distance within the first end 51. The end of first bore 53 adjacent the first end of the mandrel includes a flared section 58. A second bore 54, having a larger diameter than first bore 53, extends a predetermined distance into the second end 52. Second bore 54 includes an annular recess 56 located a predetermined distance within the second bore 54. An annular step 57 is formed where first bore 53 and second bore 54 meet. An annular tapered ridge 55 is provided along an outer surface of the mandrel 50.

Figure 7A:
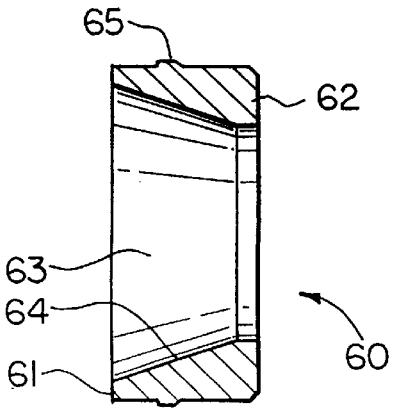
FIG. 7A is a cross-sectional side view of the insert of FIG. 7.
Figure 7:
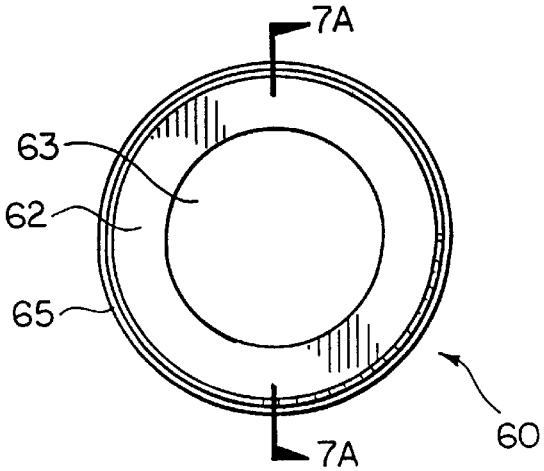
FIG. 7 is an end view of an insert.

Referring now to FIGS. 7 and 7A insert 60 is shown. Insert 60 is comprised of brass or other conductive material and is open on each of a first end 61 and a second end 62. A bore 63 is centrally disposed through insert 60. A first section 64 of the bore 63 is tapered. A tapered annular ridge 65 extends radially about the exterior surface of insert 60.

Figure 8:
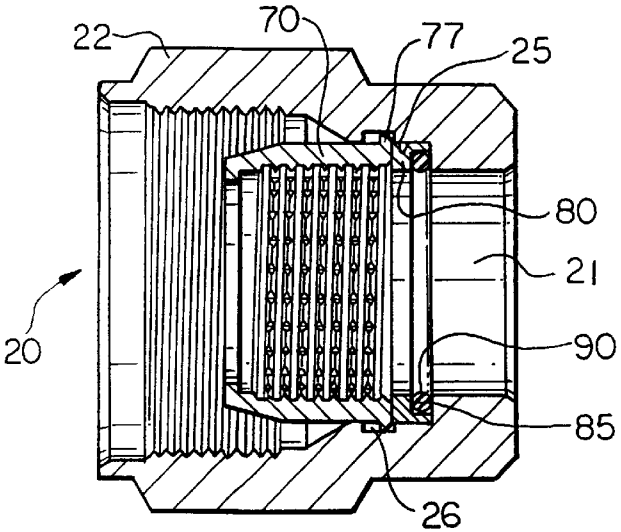
FIG. 8 is a cross-sectional side view of a clamp nut assembly.
Figure 9A:
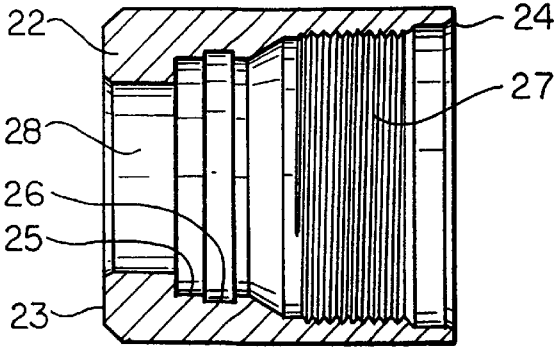
FIG. 9A is a cross-sectional side view of the clamp nut of FIG. 9.

The clamp nut assembly 20, shown in FIG. 8, comprises a clamp nut body housing 22 having a bore 24 extending therethrough. A ferrule 70, an o-ring carrier 80 and an o-ring 90 are disposed along a common longitudinal axis within the central bore 24 of clamp nut body housing 22. The ferrule 70 includes an annular lip 77 which is configured to fit within an annular recess 26 in the clamp nut body 22. A second annular recess 25 in clamp nut body 22 receives o-ring holder 80, which is positioned within the clamp nut body 22 abutting end 72 of ferrule 70. An o-ring 90 is received within an annular recess 85 in an end of o-ring holder 80.

Figure 9:
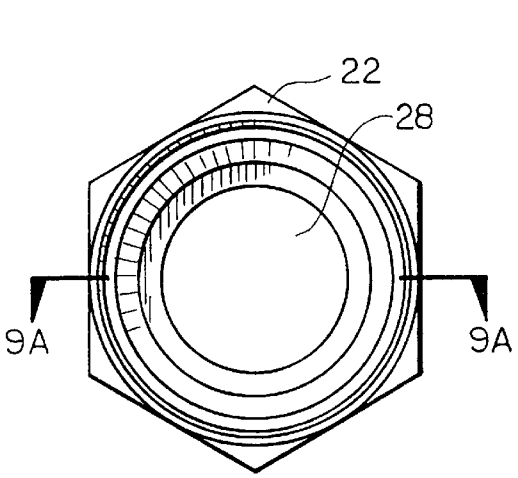
FIG. 9 is an end view of a clamp nut.
Figure 9B:
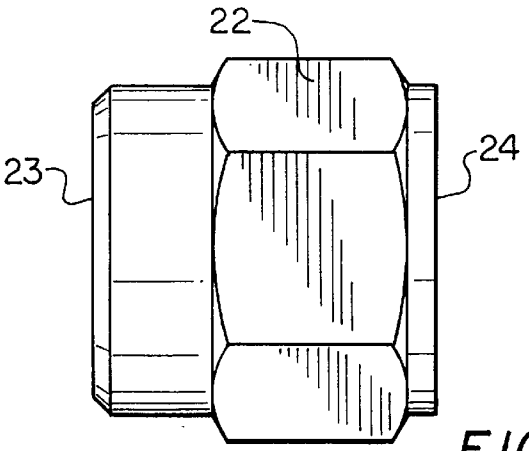
FIG. 9B is a side-view of the clamp nut of FIG. 9.

FIGS. 9–9B show the clamp nut body housing 22. A center section of clamp nut body 22 is hexagonally shaped in order to provide a surface that allows for sufficient tightening of the clamp nut body 22 to an entry body. The clamp nut body housing 22 is comprised of a conductive non-corrosive material such as aluminum and is open on each of a first end 23 and a second end 24. Clamp nut body housing 22 has a central bore 28 disposed therethrough. The central bore 28 includes a first annular step 25, a second annular step 26 and a threaded portion 27.

Figure 10:
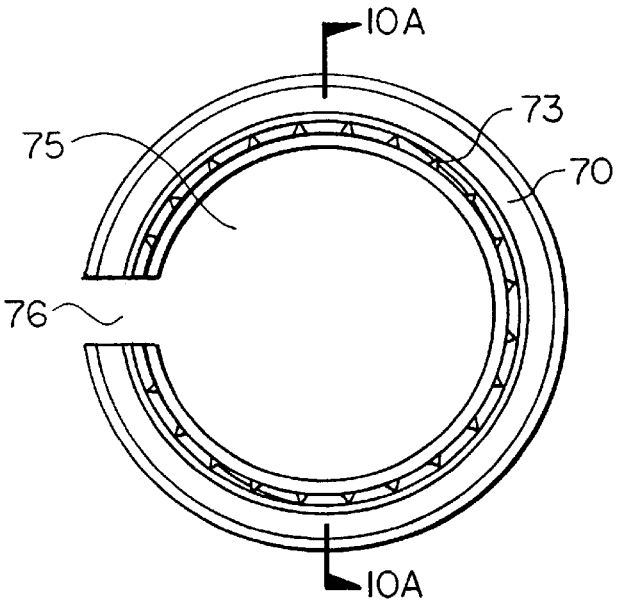
FIG. 10 is an end view of a ferrule.
Figure 10A:
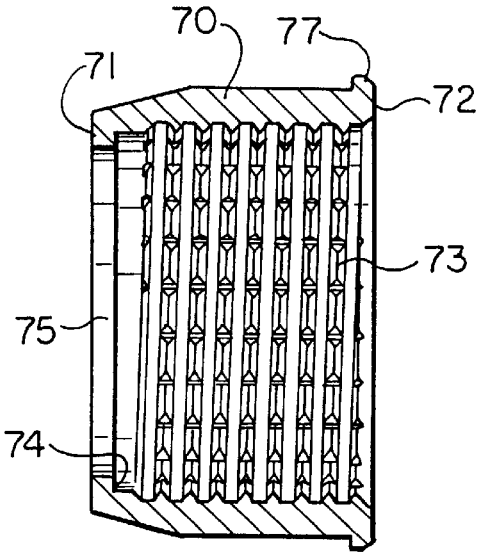
FIG. 10A is a cross-sectional side view of the ferrule of FIG. 10.

Referring now to FIGS. 10 and 10A, ferrule 70 is shown. Ferrule 70 is comprised of aluminum or other conductive material and is open on each of a first end 71 and a second end 72 and has a central bore 75 extending therethrough. A channel 76 extends through a section of the ferrule, thereby providing for the ferrule to be compressible from a first diameter to a second smaller diameter. A first annular step 74 is provided within central bore 75. A plurality of serrations 73 are provided along an interior surface of ferrule 70. An exterior annular ridge 77 is provided about an exterior surface of the ferrule 70, adjacent the second end 72.

Figure 11:
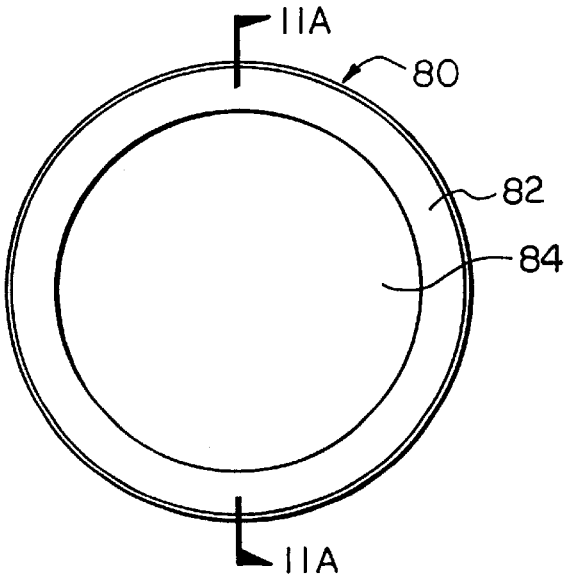
FIG. 11 is an end view of an o-ring carrier.
Figure 11A:
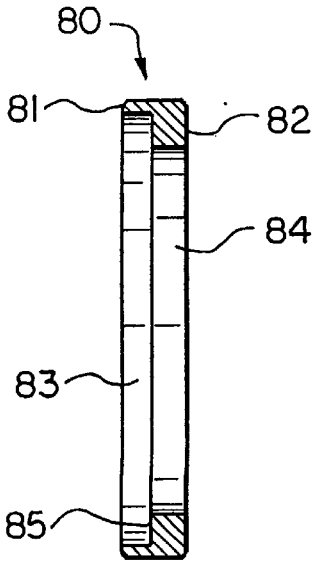
FIG. 11A is a cross-sectional side view of the o-ring carrier of FIG. 11.

O-ring holder 80 is shown in FIGS. 11 and 11A. O-ring holder 80 is comprised of brass or other conductive material and is open on each of a first end 81 and a second end 82. O-ring holder 80 also includes a first bore 83 extending from the first end 81 and a second bore 84, having a smaller diameter than first bore 83, extending from the second end 82. An annular step 85 is formed where first bore 83 meets second bore 84.

Referring back to FIG. 1, the connector 1 is assembled as follows. A length of power cable 200 is provided to the clamp nut assembly 20. The power cable has had one end prepared for having the connector 1 assembled onto. As a result of the preparation of an end, the power cable 200 has a length of center power conductor 210 exposed. A section of power conductor insulator 220 has also been removed. Additionally an end most section of the power cable insulating jacket 240 has been removed exposing a section of conductive sheath or braid 230.

The prepared end of the power cable is inserted into a rear end 3 of the clamp nut assembly 20. As the prepared end of power cable 200 enters the clamp nut assembly 20, power conductor 210 is encircled by, and extends beyond mandrel 50, insert 60 and into the bore of pin terminal 30.

Additionally, an end section of mandrel 50 is surrounded by the conductive sheath 230 of the power cable, while a section of the exposed portion of the conductive sheath 230 is surrounded by ferrule 70. When entry body assembly 10 is mated with clamp nut assembly 20, a plurality of connections between sections of the power cable 200 and sections of the connector 1 are made. As entry body assembly 10 is integrated with clamp nut assembly 20, the open end of pin terminal 30, which has power conductor 210 disposed therein, is forced against the tapered bore 64 of insert 60, which causes the ends of pin terminal 30 to compress and be forced against power conductor 210. The plurality of serrations 35 disposed on the inside surface of the bore of pin terminal 30 are brought into contact with power conductor 210, thereby providing a secure electrical and mechanical connection between the pin terminal 30 and the power conductor 210. Additionally, as the rear end of entry body assembly is integrated with clamp nut assembly 20, the front end of ferrule 70 is forced inwards by the action of entry body 12 forcibly contacting the truncated conical surface exterior surface of ferrule 70. The conductive sheath 230 is thus secured between the ferrule 70 and the mandrel 50. The action of ferrule 70 being forced inwards causes the plurality of serrations 73 present on the interior surface of ferrule 70 to press against the conductive sheath 230. Accordingly, a secure mechanical and electrical connection between ferrule 70 and conductive sheath 230 is produced.

Protection against contaminates and a reduction of the degradation of the power signals are provided. Located within clamp nut 12 is an o-ring carrier 80. O-ring carrier 80 is comprised of tin-plated brass in this embodiment, though other conductive materials could also be used. O-ring carrier 80 has an annular race for securing o-ring 90 between the power cable conductive sheath 230 and clamp nut 22. O-ring 92 is provided between entry body assembly 10 and clamp nut assembly 20, and o-ring 94 is provided between entry support 40 and entry body 12 to keep contaminants from entering the connector. Additionally, a seal is accomplished between the pin terminal 30 and entry support 40 by the serrated rings 37 of entry support 40 (shown in FIG. 4A). O-ring 96 is provided around the outside of entry body 40 so that a moisture free connection can be made between the connector 1 and its intended receiver. The o-rings 90, 92, 94 and 96 are comprised of a material which provides ultraviolet light (UV) and ozone stability for maximum resistance to atmospheric ingress. In this manner the o-rings provide for a reduction in the degradation of the power signal. Additionally, the o-rings serve to seal out contaminants that accelerate galvanic corrosion.

Figure 12:
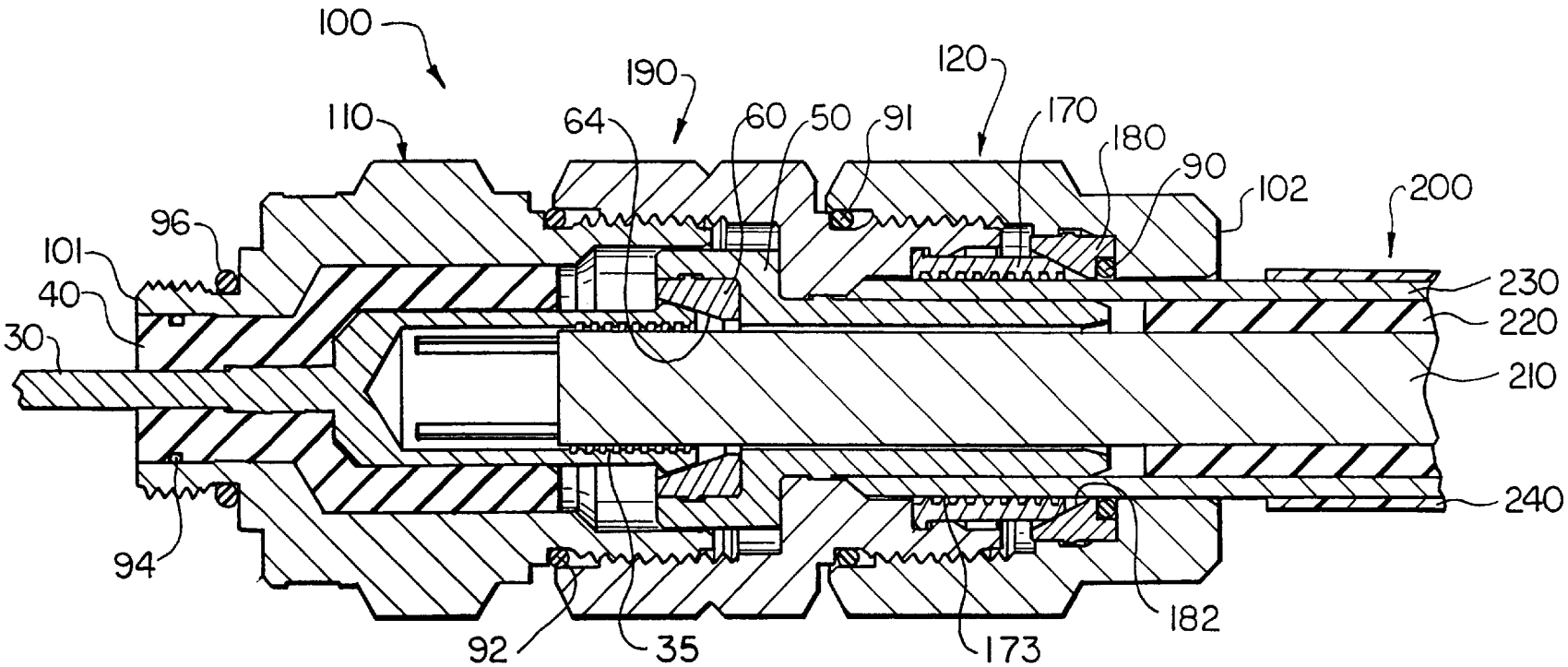
FIG. 12 is a cross-sectional side view of a three piece power connector of the present invention.

FIG. 12 shows a three piece power connector 100. In this embodiment the power connector 100 comprises an entry body assembly 110, mated with a center housing assembly 190, which is mated with a clamp nut assembly 120. The three piece connector 100 is configured to accept a power cable 200 at a first end 102, and to mate with a CATV housing at a second end 101.

Figure 13:
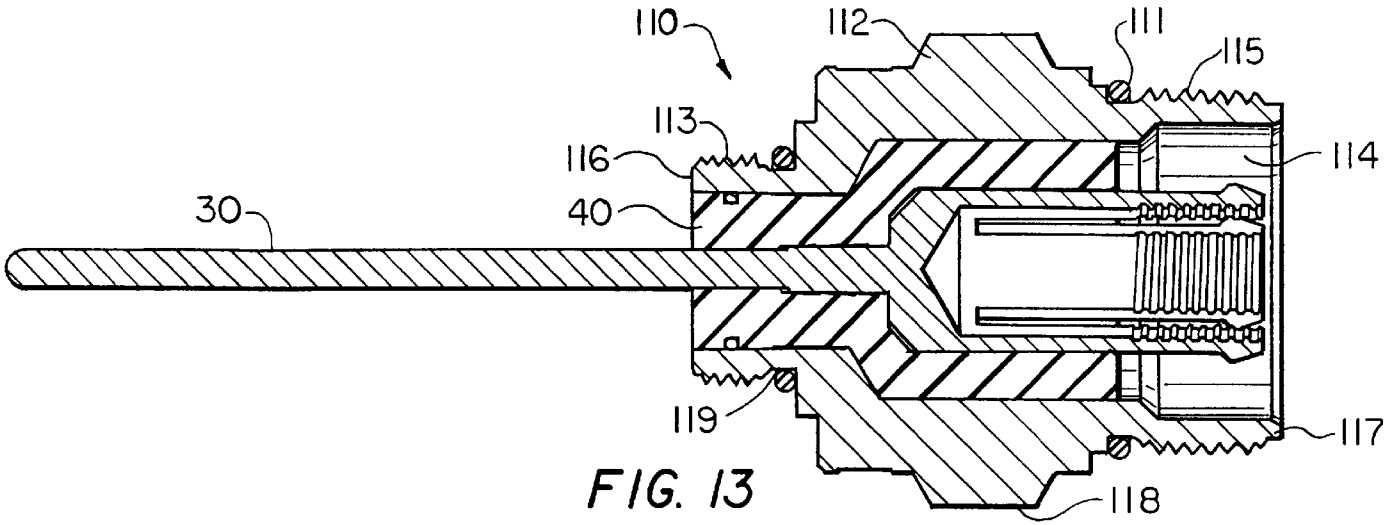
FIG. 13 is a cross-sectional side view of an entry body assembly.

The entry body assembly 110, shown in FIG. 13, comprises an entry body housing 112 open on each end 117, 116 and having a bore 114 centrally disposed through the housing 112. A pin terminal 30 and an entry support 40 are disposed along a common longitudinal axis within the central bore 114 of entry body housing 112. The entry support 40 is positioned such that one end is adjacent the first end 116 of the entry body housing 112. The pin terminal 30 is positioned within the bore of the entry support 40 and has a section extending beyond the first end 116 of the entry body housing 12.

The entry body 112 is comprised of aluminum or other corrosion resistant material. A first end of the body 116 includes a threaded section 113 which is configured to mate with a cooperating CATV housing (not shown). A center section 118 of entry body 112 is hexagonally shaped in order to provide a surface that allows for sufficient tightening of first end 116 to the CATV housing. A second end 117 of entry body 112 includes a threaded section 115 which is configured to mate with another piece of the connector. Entry body 112 further includes a first exterior annular recess 111 and a second exterior annular recess 119, each configured to receive an o-ring therein.

Figure 14:
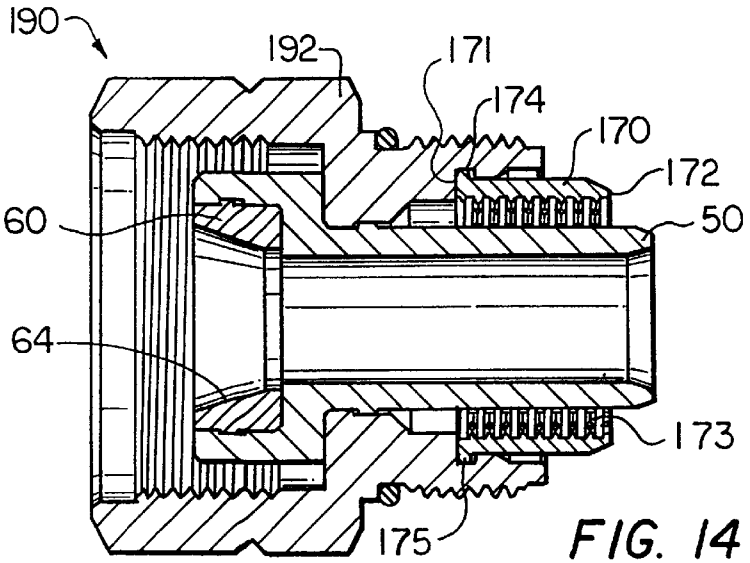
FIG. 14 is a cross-sectional side view of a center housing assembly.

The center housing assembly 190 is shown in FIG. 14. The center housing assembly 190 comprises a center housing body 192 including a mandrel 50, a ferrule 170 and an insert 60 centrally disposed therein along a common longitudinal axis. Insert 60 has an exterior flange which is configured to fit inside an annular slot of mandrel 50, thereby maintaining insert 60 within a section of mandrel 50. Mandrel 50 also includes an annular flange which is configured to fit inside an annular slot in center housing body 192, thereby maintaining mandrel 50 within center housing body 192. Ferrule 170 is disposed within an end of center housing body 192, and is comprised of aluminum or other conductive material. Ferrule 170 is open on each of a first end 171 and a second end 172 and has a central bore extending therethrough. A channel extends through a section of the ferrule, thereby providing for the ferrule to be compressible from a first size to a second smaller size. An annular slot 174 is provided within center housing body 192 and is configured to receive the ferrule annular ridge 175 therein. A plurality of serrations 173 are provided along an interior surface of ferrule 170. The center housing body 192 is comprised of a conductive non-corrosive material such as aluminum and includes an end section hexagonally shaped to allow for sufficient tightening to the clamp nut assembly.

Figure 15:
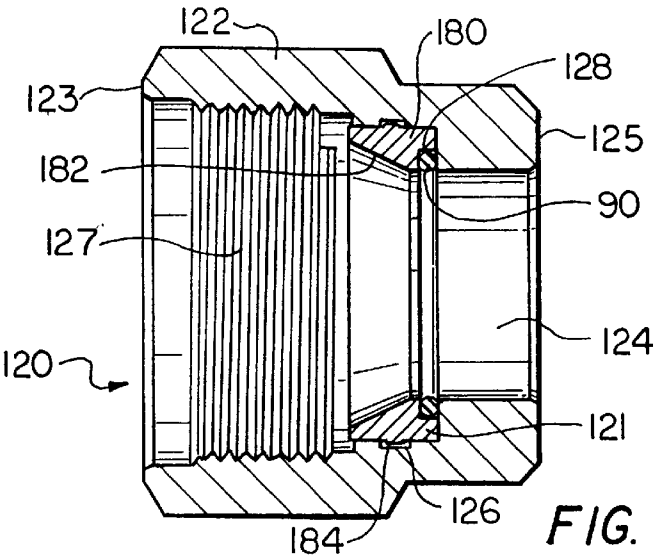
FIG. 15 is a cross-sectional view of a clamp nut assembly.

The clamp nut assembly 120 is shown in FIG. 15. The clamp nut assembly comprises a clamp nut body housing 122 having a bore 124 extending therethrough. An o-ring carrier 180 and o-ring 90 are disposed along a common longitudinal axis within the central bore 124 of clamp nut body housing 122. A section of clamp nut body 122 is hexagonally shaped in order to provide a surface that allows for sufficient tightening of the clamp nut body 122 to a center housing assembly body. The clamp nut body housing 122 is comprised of a conductive non-corrosive material such as aluminum and is open on each of a first end 123 and a second end 125. Clamp nut body housing 122 has a central bore 124 disposed therethrough. The central bore 124 includes an annular step 121 a threaded portion 127.

O-ring holder 180 is comprised of brass or other conductive material and is open on each of a first end and a second end. A tapered surface 182 is provided for engaging the ferrule when the connector is assembled. O-ring holder 180 includes an annular ridge 184 which fits inside an annular slot 126 of clamp nut body 122. The o-ring holder 180 is positioned abutting the annular step 121 of clamp nut body 122, and provides an o-ring recess 128 for retaining an o-ring 90.

Referring back to FIG. 12, the three piece connector 100 is assembled as follows. A length of power cable 200 is provided to the clamp nut assembly 120. The power cable has had one end prepared for having the three piece connector 100 assembled onto. As a result of the preparation of an end, the power cable 200 has a length of center power conductor 210 exposed. A section of power conductor insulator 220 has also been removed. Additionally an end most section of the power cable insulating jacket 240 has been removed exposing a section of conductive sheath or braid 230.

The prepared end of the power cable is inserted into a rear end 102 of the clamp nut assembly 120. As the prepared end of power cable 200 enters the clamp nut assembly 20, power conductor 210 extends through the clamp nut assembly 120 while conductive sheath 230 extends to the end of clamp nut assembly 120. The exposed section of the conductive sheath 230 is surrounded by ferrule 170, o-ring holder 180 and o-ring 90.

Center housing assembly 190 is positioned such that mandrel 50 extends about power conductor 210 and has a portion surrounded by conductive sheath 220. As center housing assembly 190 is integrated with clamp nut assembly 120, ferrule 170 is axially driven against the tapered bore 182 of o-ring holder 180, resulting in ferrule 170 being compressed. As ferrule 170 compresses, the serrations 173 on the inner surface of ferrule 170 are driven into contact with conductive sheath 230 against mandrel 50, thereby providing a secure electrical and mechanical connection between ferrule 170 and conductive sheath 230.

As entry body assembly 110 is integrated with center housing assembly 190, the open end of pin terminal 30, which has power conductor 210 disposed therein, is forced against the tapered bore 64 of insert 60, which causes the end of pin terminal 30 to be forced against power conductor 210 as it compresses. The serrations 35 disposed on the inside surface of the bore of pin terminal 30 are brought into contact with power conductor 210, thereby providing a secure electrical and mechanical connection between the pin terminal 30 and the power conductor 210.

Protection against contaminates and a reduction of the degradation of RF signals are provided. Located within clamp nut assembly 120 is an o-ring carrier 180. O-ring carrier 180 is comprised of tin-plated brass in this embodiment, though other conductive materials could also be used. O-ring carrier 80 has an annular race for securing o-ring 90 between the power cable conductive sheath 230 and clamp nut assembly 120. O-ring 91 is provided between clamp nut assembly 120 and center housing assembly 190, o-ring 92 is provided between entry body assembly 110 and center housing assembly 190, and o-ring 94 is provided between entry support 40 and entry body assembly 110 to keep contaminants from entering the connector. Additionally, a seal is accomplished between the pin terminal 30 and entry support 40 by the serrated rings 37 of entry support 40 (shown in FIG. 4A). O-ring 96 is provided around the outside of entry body assembly 110 so that a moisture free connection can be made between the connector and its intended receiver. The o-rings 90, 91, 92, 94 and 96 are comprised of a material which provides ultra-violet light (UV) and ozone stability for maximum resistance to atmospheric ingress. In this manner the o-rings provide for a reduction in the degradation of the power signal. Additionally, the o-rings serve to seal out contaminants that accelerate galvanic corrosion.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A two piece power connector comprising:

an entry body assembly comprising an entry body defining an interior space, open on each of a first end and a second end, the first end having a first mating area, the second end having a second mating area;

a pin terminal centrally disposed along a common longitudinal axis within entry body, having a first end and a second end, the first end of said pin terminal including a central bore having a plurality of serrations, longitudinally disposed along an interior surface of said bore, the serrations sized and configured to secure a power conductor within the bore and provide electrical contact between the power conductor and said terminal pin, said bore having a diameter greater than an AWG#14 conductor, the second end of said pin terminal extending beyond the first end of said entry body;

an entry support disposed along said common longitudinal axis within said entry body, having a central bore disposed therethrough, the central bore surrounding a portion of said pin terminal including a portion surrounding said pin terminal central bore; and a mandrel disposed along said common longitudinal axis within said entry body, having a first end and a second end and including a central bore having a diameter greater than an AWG#14 conductor disposed therethrough, the second end of said mandrel extending beyond the first end of said entry body, the first end of the mandrel overlapping the first end of said pin terminal; and a clamp nut assembly comprising a clamp nut body defining an interior space, open on each of a first end and a second end and having a central bore having a diameter greater than an AWG#14 conductor disposed therethrough, the first end for receiving a power cable therein, the second end having a mating area cooperating with the second mating area of said second end of said entry body;

a ferrule defining an interior space, open on each of a first end and a second end, having a channel longitudinally disposed therethrough to allow compression, disposed along said common longitudinal axis within said clamp nut interior space, an outside surface of said ferrule including a tapered section for engaging the second end of said entry body.

2. The connector of claim 1 wherein said pin terminal includes a plurality of ridges for providing a seal between said pin terminal and said entry support.

3. The connector of claim 1 wherein said ferrule includes a plurality of annular serrations disposed along an interior surface thereof for providing electrical connections with a conductive sheath of the power cable by movement of said entry body along the tapered section of said ferrule when said entry body is integrated with said clamp nut.

4. The connector of claim 1 further comprising an insert having a central bore disposed therethrough, disposed along said common longitudinal axis within said second end of said mandrel, said insert having a sloping interior surface for engaging said first end of said pin terminal.

5. The connector of claim 1 wherein said pin terminal is sized to conduct a voltage of at least approximately ninety volts.

6. The connector of claim 1 wherein said pin terminal is sized to conduct a current of at least approximately thirty amperes.

7. The connector of claim 1 wherein said entry body and said clamp nut body comprise corrosion resistant material.

8. The connector of claim 1 wherein said entry body and said clamp nut body comprise aluminum.

9. The connector of claim 1 wherein said entry body, said clamp nut body, said pin terminal, and said ferrule comprise electrically conductive material.

10. The connector of claim 1 wherein said entry support and said mandrel comprise electrically insulating material.

11. The connector of claim 1 wherein said pin terminal comprises brass.

12. The connector of claim 1 wherein said pin terminal comprises tin plated brass.

13. The connector of claim 1 further comprising an o-ring carrier having a central bore disposed therethrough, disposed along said common longitudinal axis within said clamp nut abutting said ferrule.

14. The connector of claim 13 further comprising:

a first o-ring disposed within said o-ring carrier;

a second o-ring disposed between said clamp nut body and said entry body;

a third o-ring disposed between said entry support and said entry body assembly; and a fourth o-ring disposed along an exterior surface of said entry body.

15. A three piece power connector comprising:

an entry body assembly comprising an entry body defining an interior space, open on each of a first end and a second end, the first end having a first mating area, the second end having a second mating area;

a pin terminal centrally disposed along a common longitudinal axis within entry body, having a first end and a second end, the first end of said pin terminal including a central bore having a plurality of serrations longitudinally disposed along an interior surface of said bore, said serrations sized and configured to secure a power conductor within the bore and provide electrical contact between the power conductor and said terminal pin, said bore having a diameter greater than an AWG#14 conductor, the second end of said pin terminal extending beyond the first end of said entry body; and an entry support disposed along said common longitudinal axis within said entry body, having a central bore disposed therethrough, the central bore surrounding a portion of said pin terminal including a portion surrounding said pin terminal central bore;

a center housing assembly comprising a center housing body defining an interior space, open on each of a first end and a second end, the first end having a second mating area for mating with the first mating area of said second end of said entry body, the second end having a second mating area;

a mandrel disposed along said common longitudinal axis within said center housing body, having a first end and a second end and including a central bore having a diameter greater than an AWG#14 conductor disposed therethrough, the first end of said mandrel extending beyond the second end of said center housing body, the second end of the mandrel overlapping the first end of said pin terminal when said entry body assembly and said center housing assembly are mated; and a ferrule defining an interior space, open on each of a first end and a second end, having a channel longitudinally disposed therethrough to allow compression disposed along said common longitudinal axis within said center housing body interior space, an outside surface of said ferrule including a tapered section; and a clamp nut assembly comprising a clamp nut body defining an interior space, open on each of a first end and a second end and having a central bore disposed therethrough, the second end for receiving a power cable therein, the first end having a mating area cooperating with the second mating area of said center housing body.

16. The connector of claim 15 wherein said pin terminal includes a plurality of ridges for providing a seal between said pin terminal and said entry support.

17. The connector of claim 15 wherein said ferrule includes a plurality of annular serrations disposed along an interior surface thereof for providing electrical connections with a conductive sheath of a power cable by movement of said clamp nut body along the tapered section of said ferrule when said center housing body is integrated with said clamp nut.

18. The connector of claim 15 further comprising an insert having a central bore disposed therethrough, disposed along said common longitudinal axis within a first end of said mandrel, said insert having a sloping interior surface for engaging said first end of said pin terminal.

19. The connector of claim 15 wherein said pin terminal is sized to conduct a voltage of at least approximately ninety volts.

20. The connector of claim 15 wherein said pin terminal is sized to conduct a current of at least approximately thirty amperes.

21. The connector of claim 15 wherein said entry body, said clamp nut body, said center housing body, said pin terminal, and said ferrule comprise electrically conductive material.

22. The connector of claim 15 wherein said entry support and said mandrel comprise electrically insulating material.

23. The connector of claim 15 wherein said entry body, said center housing body and said clamp nut body comprise corrosion resistant material.

24. The connector of claim 15 wherein said entry body, said center housing body and said clamp nut body comprise aluminum.

25. The connector of claim 15 wherein said pin terminal comprises brass.

26. The connector of claim 15 wherein said pin terminal comprises tin plated brass.

27. The connector of claim 15 further comprising an o-ring carrier having a central bore disposed therethrough, disposed along said common longitudinal axis within said clamp nut body, said o-ring carrier abutting said ferrule when said center housing assembly is integrated with said clamp nut assembly.

28. The connector of claim 27 further comprising:

a first o-ring disposed within said o-ring carrier;

a second o-ring disposed between said clamp nut body and said center housing body;

a third o-ring disposed between said entry support and said entry body assembly;

a fourth o-ring disposed along an exterior surface of said entry body; and a fifth o-ring disposed between said center housing body and said entry body assembly.

* * * * *